United States Patent [19]

Eynon et al.

[11] Patent Number: 4,522,687

[45] Date of Patent: Jun. 11, 1985

[54] FLOW BOX WITH TWO DEFLECTORS

[75] Inventors: David L. Eynon; Stanley W. Kingsnorth, both of Cumbria; Mani K. Varma, Essex, all of England

[73] Assignee: Internationale Octrooi Maatschappij "Octropa" B.V., Rotterdam, Netherlands

[21] Appl. No.: 463,868

[22] PCT Filed: Jul. 2, 1982

[86] PCT No.: PCT/GB82/00195

§ 371 Date: Jan. 20, 1983

§ 102(e) Date: Jan. 20, 1983

[87] PCT Pub. No.: WO83/00173

PCT Pub. Date: Jan. 20, 1983

[30] Foreign Application Priority Data

Jul. 2, 1981 [GB] United Kingdom ..... 8120468

[51] Int. Cl.[3] ..... D21F 1/02; D21F 1/04

[52] U.S. Cl. ..... 162/336; 162/343

[58] Field of Search ..... 162/336, 337, 338, 339, 162/343

[56] References Cited

U.S. PATENT DOCUMENTS 3,236,725 2/1966 Goldsmith ..... 162/336

3,565,758 2/1971 Higgins et al. ..... 162/336

FOREIGN PATENT DOCUMENTS 1467479 3/1977 United Kingdom .

1519791 8/1978 United Kingdom .

*Primary Examiner*—S. Leon Bashore

*Assistant Examiner*—K. M. Hastings

*Attorney, Agent, or Firm*—Cushman, Darby & Cushman

[57] ABSTRACT

A flow box for a paper making machine comprises an explosion chamber fed with stock from two rows of pipes entering the top wall thereof, a first deflector within the explosion chamber extends across the axial direction of a first row of pipes and a second deflector below the first deflector extends across at least the axial direction of the second row of pipes, a surface of the first deflector forming a divergent passage with the top wall of the chamber in the direction of the second row of pipes and the first and second deflectors together forming a convergent flow passage through which stock flows before entering the slice chamber.

11 Claims, 5 Drawing Figures

FLOW BOX WITH TWO DEFLECTORS

This invention relates to flow boxes or headboxes for feeding stock to form a web in the manufacture of paper or board material.

In the manufacture of paper the pulp or stock is forced under pressure through a distribution chamber from which it is carried by a series of pipes to an explosion chamber, into a slice chamber and out of a slice opening at rates of between about 400 and 2500 liters/-minute/meter width of opening. The slice opening has a width corresponding to the width of the web of paper to be formed. The stock usually contains 0.6% to 2% solid fibres and unless the solids content is evenly dispersed in the stock as it leaves the slice openings variations in the basic weight of the web of paper in the cross-machine direction can occur.

The explosion chamber is a critical part of the flow box. As indicated by the name the stock is subjected to a sudden drop in pressure as it enters the explosion chamber sometimes together with impingement on a baffle plate therein to effect thorough mixing of the stock as a result of the turbulence created.

Nevertheless it has been found that basic weight variations in the cross-machine direction still occur. Evidence of these is visible particularly when the paper is wound into reels at the end of the paper making machine by virtue of undulations in the axial direction of the wound reel. Careful analysis of the cross direction weight profile of finished web has shown that prominent weight streaks occur at intervals associated with the spacing of the pipes connecting the distribution chamber to the explosion chamber.

According to the present invention there is provided a flow box for a paper making machine comprising an explosion chamber having a base wall, a top wall and two side walls, an outlet at the bottom of one of the side walls adjacent the base wall communicating with a slice chamber extending parallel to the base wall and a plurality of inlet pipes connecting the explosion chamber to a distribution chamber, the inlet pipes communicating with two rows of openings in the top wall of the explosion chamber and having an axial direction directed towards the base wall, a first deflector having an upper surface and a lower surface, the upper surface extending across the axial direction of the pipes of a first row of openings to form a divergent passage with the top wall in the direction of the second row of openings, and terminating at a distal edge outside of the axial direction of the pipes of the second row of openings, a second deflector extending from the other of said side walls across the axial direction of the pipes of the second row of openings, the second deflector having an upper surface forming a convergent flow passage with at least a part of the lower surface of the first deflector.

A flow of stock emerges from the first row of openings and is deflected by the first deflector towards a flow of stock emerging from the second row of openings. Combined with the sudden expansion of the stock leaving the pipes the stock is intimately mixed thereby and then flows through the convergent passage formed between the first and second deflector before entering the slice chamber.

Preferably the distal edge of the first deflector is between 10 and 30 mm below the top wall of the chamber. This dimension is a function of the angle that the upper surface of the first deflector makes with the top wall of the explosion chamber and hence the direction of the deflected flow of the stock from the first row of pipes towards the flow of stock from the second row of pipes.

The minimum dimension of the convergent passage between the lower surface of the first deflector and the upper surface of the second deflector is preferably between 5 and 15 mm. This dimension has been found to be important in affecting the flow of stock from the explosion chamber to the slice chamber.

Preferably the maximum dimension of the convergent passage is between 10 mm and 30 mm.

The upper surface of the second deflector can be inclined towards the first row of openings over that portion thereof which is aligned with the axial direction of the pipes of the second row of openings. This construction deflects the flow of stock from the second row of pipes directly towards the flow of stock from the first row of pipes. Alternatively the upper surface of the second deflector can be inclined away from the first row of openings at least over that portion thereof which is aligned with the axial direction of the pipes of the second row of openings. In this construction the flow of stock from the second row of pipes can be deflected by the second deflector towards the side wall of the explosion chamber and thence back across that flow towards the flow from the first row of pipes.

The lower surface of the first deflector can extend from the distal edge of the upper surface to the side wall adjacent the first row of openings. The convergent passage formed between respective parts of the lower surface of the first deflector and the upper surface of the second deflector then extends in the direction away from the top wall of the explosion chamber.

Alternatively the first deflector can be provided with an impingement surface extending from the distal edge of the upper surface to lie at least partially across the axial direction of the pipes of the second row of openings, the lower surface extending from the impingement surface to the side wall adjacent the first row of openings. The impingement surface tends to direct the flow from the second row of openings towards the side wall adjacent the second row of openings to improve the intermixing of the flows from the two rows of openings. The lower surface of the first deflector and the upper surface of the second deflector can be disposed so that the convergent flow passage extends generally in the upward direction away from the base wall of the explosion chamber. This is believed to contribute to improved mixing of the stock at lower flow rates by reducing gravitational flow of stock through the convergent passage.

A second convergent flow passage can also be provided between the lower surface of the second deflector and the base of the explosion chamber in order to further create conditions under which the intermixing of the stock is effected.

The two rows of inlet pipes are preferably fed from a distribution chamber which is tapered in the direction away from the stock inlet thereto.

Embodiments of the invention will now be more particularly described with reference to the accompanying diagrammatic drawings in which.

Figure 1:
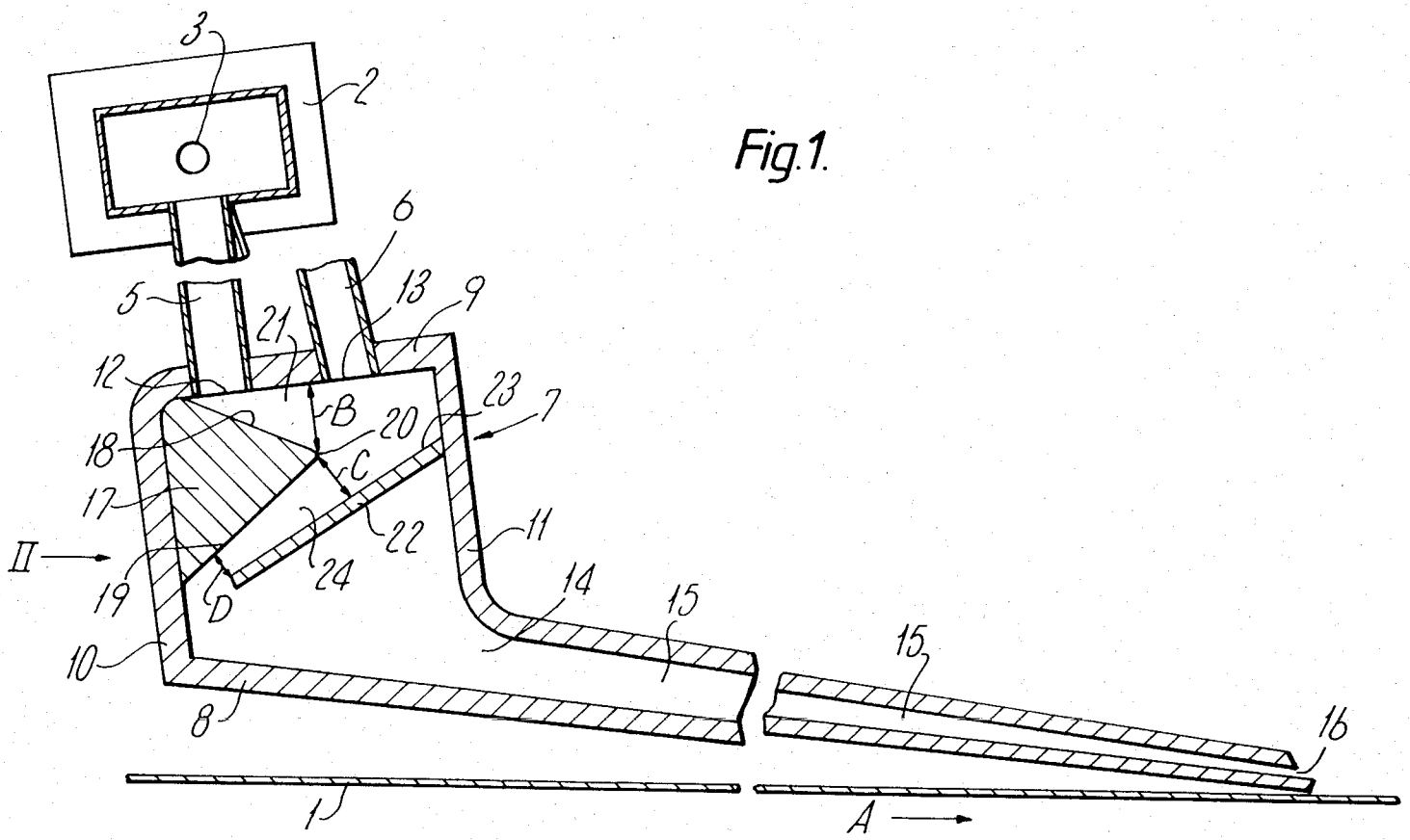
FIG. 1 is a sectional side elevation of a flow box.
Figure 2:
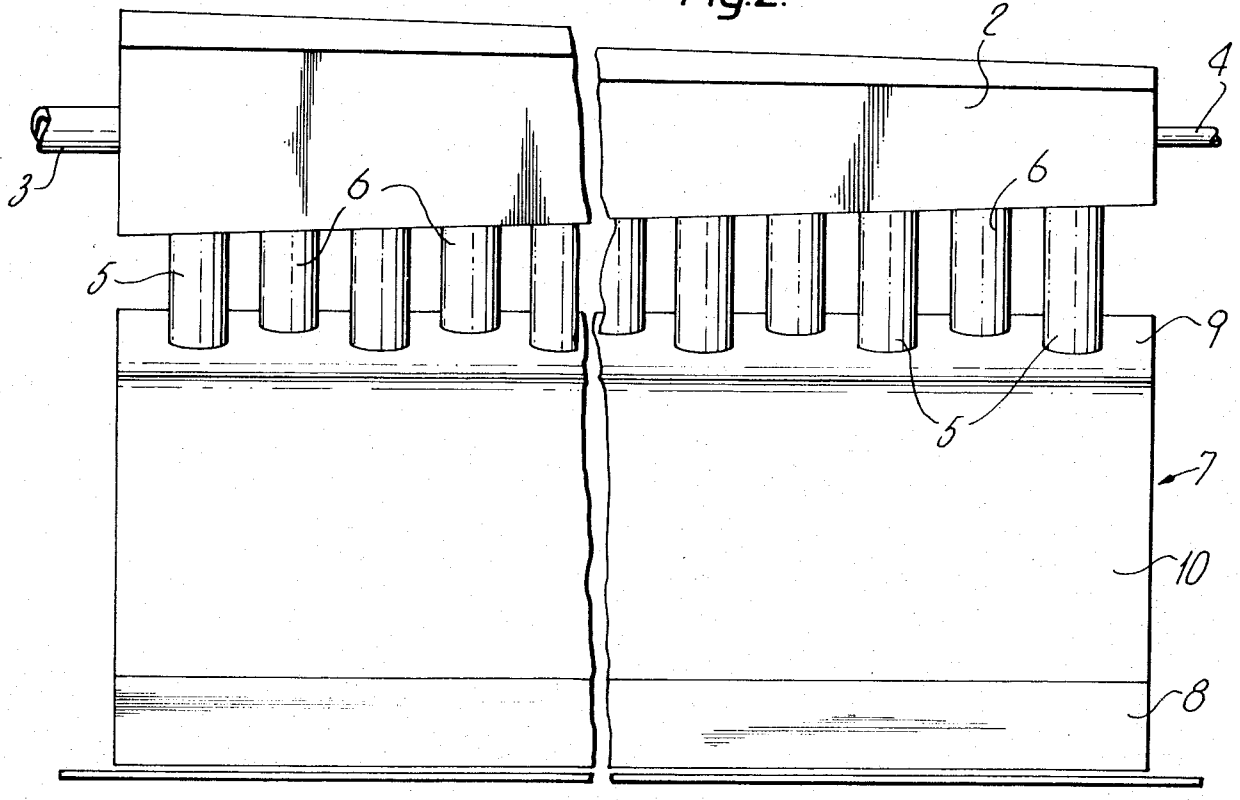
FIG. 2 is a plan view of the flow box of FIG. 1 in the direction of arrow II.

Referring to FIGS. 1 and 2 a paper making belt 1 travelling in the direction of arrow 'A' passes below a flow box. The stock comprising a suspension of fibres in water is fed under pressure to one end of a distribution chamber 2 which tapers in cross-section as shown in FIG. 2 from the stock inlet 3 across the width of the machine. An overflow 4 is provided at the narrower end of the distribution chamber.

A plurality of inlet pipes extend from the distribution chamber in two rows 5 and 6 downwardly to an explosion chamber 7 defined by a base wall 8, top wall 9 and two side walls 10 and 11. The rows 5 and 6 of inlet pipes communicate with two rows of openings 12 and 13 respectively in the top wall of the explosion chamber.

An outlet 14 from the explosion chamber is provided at the bottom of the side wall 11 adjacent the base wall. The outlet 14 communicates with a slice chamber 15 terminating in a slice opening 16 from which the stock issues in a wide band onto the paper making web 1.

Within the explosion chamber is a first deflector 17 having an upper surface 18 and a lower surface 19 oblique to one another.

The upper surface 18 extends below the row of openings 12 across the axial direction of the row of pipes 5 to terminate at a distal edge 20. The upper surface 18 forms a divergent passage 21 having a maximum dimension 'B' from the top wall of the expansion chamber at the distal edge 20. The upper surface 18 does not extend across the axial direction of the row of pipes 6 which connect with the second row of openings 13.

The lower surface 19 of the deflector 17 extends from the distal edge 20 to the side wall 10 of the explosion chamber.

A second deflector 22 having an upper surface 23 extends from the side wall 11 below the openings 13 of the second row of pipes 6 to intersect the axial direction of those pipes. The upper surface 23 defines with the lower surface 19 of the first deflector a convergent passage 24 therebetween having a maximum dimension 'C' and a minimum dimension 'D'. The portion of the upper surface 23 which lies in the axial direction of the pipes 6 is inclined towards the first row of openings 12.

In operation stock is pumped into the distribution chamber 2 to pass through the rows of pipes 5 and 6, a small overflow passing through the overflow 4 which together with the tapering cross section of the distribution chamber helps to maintain equal flows of stock in each of the pipes. The stock enters the explosion chamber 7 through the openings 12 and 13 in the top wall 9 and is subjected to rapid expansion causing mixing of the stock. The flow from the first row of pipes 5 impinges upon the upper surface of the first deflector 17 and the flow of stock from the second row of pipes 6 impinges upon the upper surface of the second deflector 22. After impinging on the deflectors the two flows of stock are deflected towards one another and flow through the convergent passage 24 through the outlet 14 into the slice chamber and out of the slice opening 16 onto the belt 1.

Figure 3:
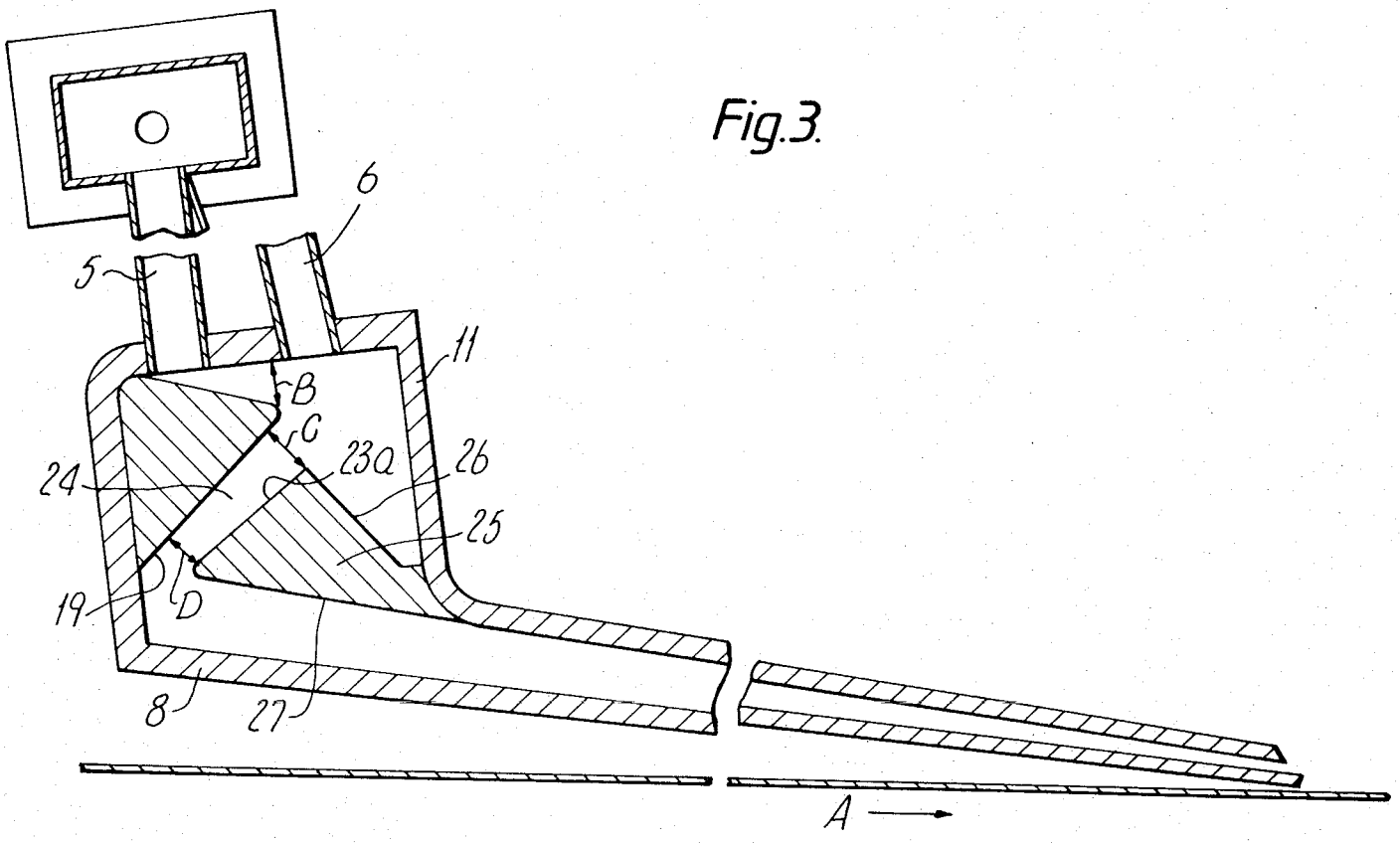
FIG. 3 is a sectional side elevation of another flow box.

Referring now to FIG. 3 there is shown a flow box as in FIGS. 1 and 2 having a modified form of second deflector 25. In this embodiment the second deflector has an upper surface 23*a* which defines a convergent passage 24 with the lower surface 19 of the first deflector as in FIG. 1 but that portion 26 of the upper surface which intersects the axial direction of the row of pipes 6 is inclined away from first row of pipes 5. The deflector 25 also has a lower surface 27 which is parallel to the plane of the base wall 8 of the explosion chamber.

The flow of stock from the second row of pipes 6 impinges on the upper surface 26 of the second deflector and is deflected towards the side wall 11 and back across the flow of stock from the pipes 6 to mix with the flow from pipes 5. The stock then flows through the convergent passage 24 and out of the slice opening as before.

Figure 5:
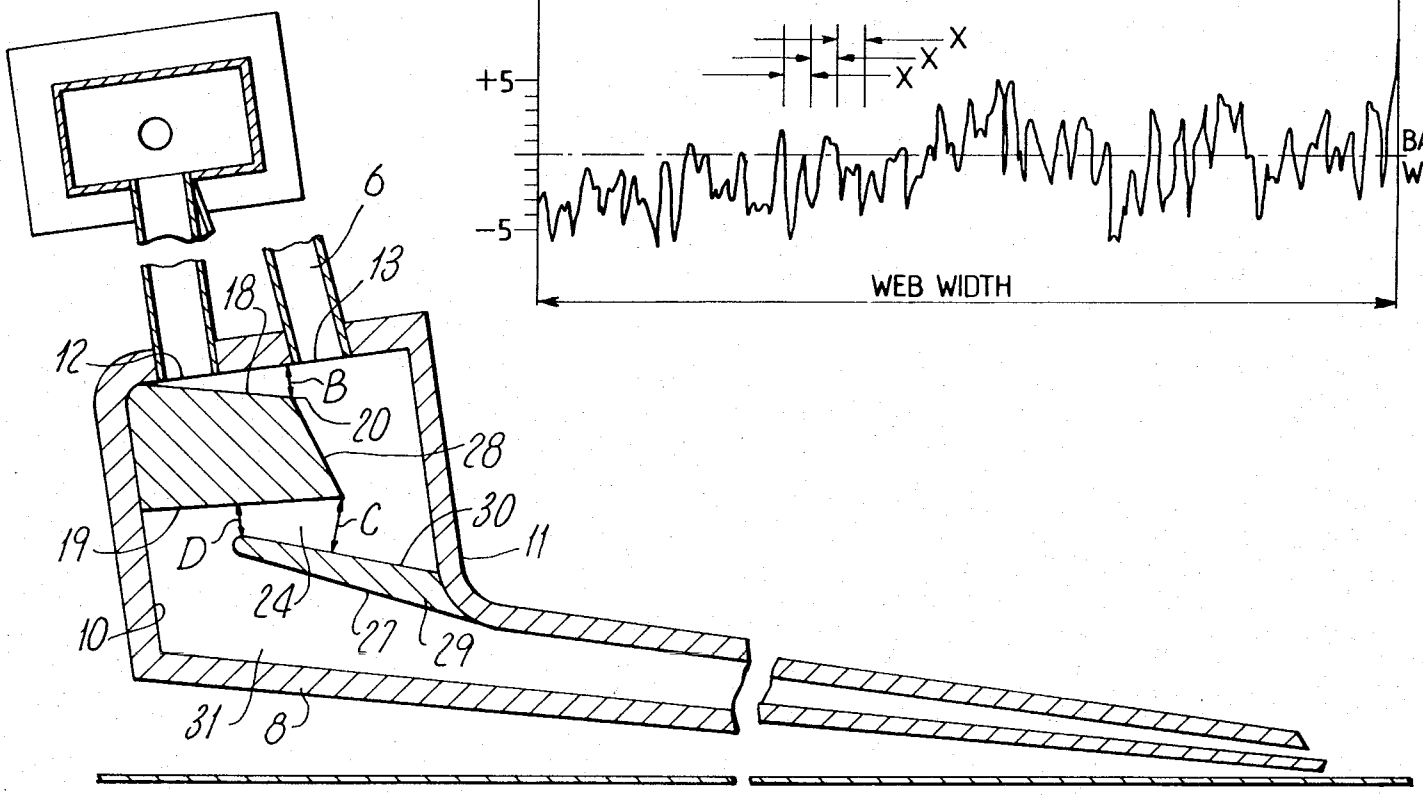
FIG. 5 is a sectional side elevation of a further flow box.

Referring now to FIG. 5 there is shown a flow box in which the first deflector again has an upper surface 18 terminating in a distal edge 20. Extending from the distal edge 20 is an impingement surface 28 which extends partially across the axial direction of the pipes 6 connected to the second row of openings 13. The lower surface 19 of the first deflector extends from the impingement surface 28 to the side wall 10 adjacent the first row of openings 12.

A second deflector 29 extending from side wall 11 has an upper surface 30 which intersects the axial direction of the row of pipes 6 and which is inclined away from the first row of openings. A part of the upper surface 30 forms a convergent flow passage 24 with the lower surface 19 of the first deflector, the convergent passage extending in the generally upward direction away from the base wall 8.

The second deflector has a lower surface 27 which together with the base wall 8 forms a second convergent passage 31 in the direction of the slice chamber.

In each of the embodiments described certain like dimensions preferably lie within particular ranges to provide mixing of the stock to minimise weight variations in the web of paper attributable to the flow box. The dimension B between the distal edge of the upper surface of the first deflector and the top wall of the explosion chamber should be between 10 and 30 mm, preferably between 12 and 25 mm. The minimum dimension D of the convergent flow passage should be between 5 and 15 mm, preferably 9 mm and the maximum dimension C of the convergent flow passage should be between 10 and 30 mm, preferably between 18 and 25 mm.

Trials were conducted using flow boxes as shown in FIG. 1 and FIG. 5 to make a paper web and compared to web made using a flow box without such baffles but having a flexible divider sheet extending from the top wall of the explosion chamber towards the slice chamber generally as described in British Patent Specification No. 1 595 559. Experiments were also conducted on apparatus in which the base wall of the flow box and the underside of the slice chamber were of transparent plastics material so that the flow of stock therethrough could be observed.

Using the experimental apparatus the performance of flow boxes according to the invention were assessed before running machine trials. Two experimental flow boxes were made as shown in FIG. 1 in one of which the dimensions B, C and D were 27 mm, 18 mm and 9 mm respectively and in the second flow box were 15 mm, 25 mm and 9 mm respectively.

A further experimental flow box as shown in FIG. 3 was constructed in which the dimensions B, C and D were 15 mm, 18 mm and 12 mm respectively.

An experimental box as shown in FIG. 5 was also made in which the dimensions B, C and D were 12 mm, 16 mm and 9 mm respectively.

Stock having consistencies of between 0.6% and 2% were passed through the flow boxes in turn at rates of between 480 and 1200 liters per minute per meter width of flow box. Visual examination through the transparent panels of the flow of stock showed no stable streakiness as compared to a box without the baffles indicating that pulp fibres were more evenly distributed throughout the stock and were being evenly discharged across the width of the slice opening without any cyclical fluctuation related to the spacing between the pipes 5 and 6.

Figure 4:
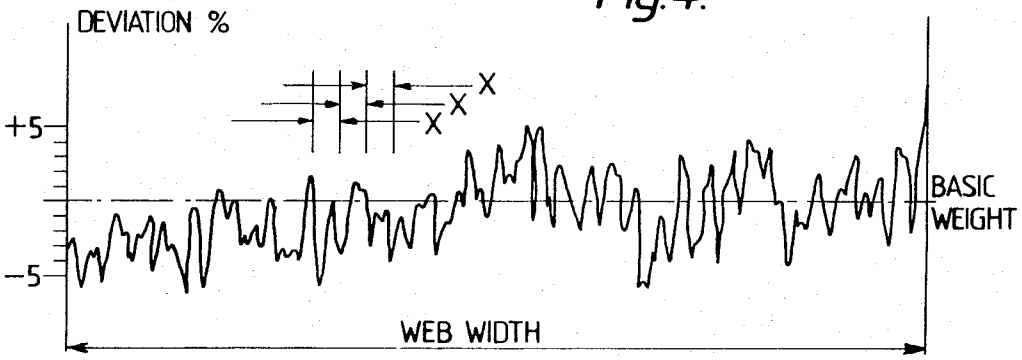
FIG. 4 is a diagram showing variations in the basic weight of a finished web of board.

Board was produced using a flow box without the baffles of the present invention and examined for basic weight variations in the cross machine direction. The overall weight variation of one typical examination is shown in FIG. 4. Careful analysis of this overall weight variation was effected to identify and separate out those weight variations occurring at intervals related to the spacing of the tubes 5 and 6 and which variations were found to occur at intervals X corresponding to the distance between adjacent pipes in each row, i.e. twice the distance between the pipes as they emerge from the distribution chamber. This examination supported the visual examination with the experimental apparatus.

Trials were conducted using the experimental flow box designs according to FIGS. 1 and 5 except that the dimension B in the first flow box according to FIG. 1 was 25 mm instead of 27 mm.

Each of the webs produced were examined and average percentage peak to peak weight variations over forty five such samples for each web as shown in FIG. 4 were obtained at several different flow rates. It was found that the first flow box according to FIG. 1 showed an overall 51% reduction in weight variations at spacings related to spacing of the tubes 5 and 6. The second flow box according to FIG. 1 showed a 40% reduction and the flow box as shown in FIG. 5 showed an average 50% reduction, the reduction being more marked at lower flow rates.

The trial results confirmed the assessments made based on the visual examinations of flows in the experimental boxes.

Whilst the invention has been described as applying stock to a paper making belt it will be apparent that a flow box according to the invention can be used at one or more stations of a paper or board making machine in which event the belt as it passes below the slice opening may already comprise a partly formed web of material.

We claim:

1. A flow box for a paper making machine comprising an explosion chamber having a base wall, a top wall and two side walls; an outlet at the bottom of one of the side walls adjacent the base wall communicating with a slice chamber extending parallel to the base wall; and a plurality of inlet pipes connecting the explosion chamber to a distribution chamber, the inlet pipes communicating with two rows of openings in the top wall of the explosion chamber and having an axial direction directed towards the base wall; a first deflector extending from one of said side walls, having an upper surface and a lower surface, the upper surface extending across the axial direction of the pipes of a first row of openings to form a divergent passage with the top wall in the direction of the second row of openings, and terminating at a distal edge outside of the axial direction of the pipes of the second row of openings; and wherein said upper surface of said first deflector does not extend across the axial direction of the pipes of the second row of openings; a second deflector extending from the other of said side walls across the axial direction of the pipes of the second row of openings, the second deflector having an upper surface forming a convergent flow passage with at least a part of the lower surface of the first deflector.

2. A flow box according to claim 1 in which the distal edge of the first deflector is between 10 and 30 mm below the top wall of the chamber.

3. A flow box according to claim 1 in which the minimum dimension of the convergent passage between the lower surface of the first deflector and the upper surface of the second deflector is between 5 and 15 mm.

4. A flow box according to claim 3 in which the maximum dimension of the convergent passage is between 10 mm and 30 mm.

5. A flow box according to claim 1 in which the upper surface of the second deflector is inclined away from the first row of openings at least over that portion thereof which is aligned with the axial direction of the pipes of the second row of openings.

6. A flow box according to claim 1 in which the upper surface of the second deflector is inclined towards the first row of openings over that portion thereof which is aligned with the axial direction of the pipes of the second row of openings.

7. A flow box according to claim 1 in which the lower surface of the first deflector extends from the distal edge of the upper surface to the side wall adjacent the first row of openings.

8. A flow box according to claim 1 in which the first deflector has an impingement surface extending from the distal edge of the upper surface to lie at least partially across the axial direction of the pipes of the second row of openings, the lower surface extending from the impingement surface to the side wall adjacent the first row of openings.

9. A flow box according to claim 8 in which the convergent flow passage extends generally upwardly away from the base wall of the explosion chamber.

10. A flow box according to claim 8 in which the second deflector has a lower surface forming a second convergent passage with the base wall of the chamber.

11. A flow box according claim 1 in which the distribution chamber is tapered away from the stock inlet thereto.

* * * * *